United States Patent [19]

Hopf

[11] Patent Number: 4,542,525

[45] Date of Patent: Sep. 17, 1985

[54] METHOD AND APPARATUS FOR CLASSIFYING AUDIO SIGNALS

[75] Inventor: Reinhard Hopf, Bamberg, Fed. Rep. of Germany

[73] Assignee: Blaupunkt-Werke GmbH, Hildesheim, Fed. Rep. of Germany

[21] Appl. No.: 536,213

[22] Filed: Sep. 27, 1983

[30] Foreign Application Priority Data

Sep. 29, 1982 [DE] Fed. Rep. of Germany ..... 3236000

[51] Int. Cl.[4] ..... H04R 29/00

[52] U.S. Cl. ..... 381/56; 381/110; 381/46

[58] Field of Search ..... 381/41, 42, 43, 46, 381/56, 110; 73/584; 455/228

[56] References Cited

U.S. PATENT DOCUMENTS

| | | | |
|---|---|---|---|
| 2,761,897 | 9/1956 | Jones | 381/58 |
| 3,448,215 | 6/1969 | Engel | 381/58 |
| 3,767,860 | 10/1973 | Brown | 381/58 |
| 3,927,260 | 12/1975 | Amundson et al. | 340/657 |
| 4,027,102 | 5/1977 | Ando et al. . | |

OTHER PUBLICATIONS

Frankeny, "Voice Detector Circuit", IBM Technical Disclosure Bulletin, vol. 20, No. 4, Sep. 1977, p. 1282.

Frankeny, "Zero Crossing Voice Detection Using Digital Sampling", IBM Technical Disclosure Bulletin, vol. 20, No. 4, Sep. 1977, p. 1280.

*Primary Examiner*—Forester W. Isen

*Attorney, Agent, or Firm*—Frishauf, Holtz, Goodman & Woodward

[57] ABSTRACT

The null transitions of an audio frequency signal are converted by Schmitt trigger circuits, one of which has a small hysteresis range centered on the null value and the other of which has a much larger hysteresis range likewise centered on the null value, into two binary pulse sequences of variable pulse lengths. The Schmitt trigger circuits are so constituted that a positive pulse length is produced by a negative null transition of the audio signal and vice versa and, moreover, the Schmitt trigger circuits return to their quiescent state 2 milliseconds after a positive null transition of the signal, also producing a positive pulse length, in this case beginning the indication of the pause. The pauses in the two binary pulse sequences thus produced, which exceed predetermined length (60 milliseconds in both cases and, additionally, 30 milliseconds in the case of the pulses formed by the Schmitt trigger with the narrower hysteresis range) and from the three different pause detection operations logic circuits derive either a speech recognition signal, a music recognition signal or an indication of an unidentifiable signal. The logic circuit uses as criteria the number of pauses and the time span of simultaneous or alternating appearance of signal pauses derived from the two different pulse sequences.

28 Claims, 3 Drawing Figures

METHOD AND APPARATUS FOR CLASSIFYING AUDIO SIGNALS

The invention concerns the classification of audio-frequency signals such as are transmitted by radio or wire, and more particularly to classifying them as speech signals, music signals or signals of an unidentifiable kind.

Such classification is particularly useful in radio receivers for making possible automatic control and adjustment functions, for example to seek out and tune in, selectively, broadcast signals which are transmitting speech, or, on the other hand, broadcast signals which are transmitting music, and also for blanking out or otherwise omitting music passages, or speech intervals, of a broadcast, for example for making a tape record of the rest. Still another use of a classification system is for automatic switching over of equalizers interposed in a transmission, reception or recording system, from a setting appropriate for music to a setting appropriate for speech and vice versa.

A classification method is known for recognition of music and of speech information in which the frequency band of the audio signal is subdivided into an upper frequency range of 6 to 10 kHz and a lower frequency range extending to 3 kHz. In this system the recognition criteria for music and for speech utilized pause periods and the duration in time of sequences in the lower frequency range of null transitions uninterrupted by pauses and also the simultaneous or alternate appearance of pauses in both frequency ranges. Such a classification method requires rather expensive circuitry for its operation, because relatively many features must be detected for classifying of the signal types.

SUMMARY OF THE INVENTION

It is an object of the present invention to improve methods and apparatus of audio signal classification by reduction of the detection criteria without sacrifice of recognition capability and thereby make it possible to use a classification method requiring less expensive equipment.

Briefly, the audio-frequency signal under investigation is used to generate first and second binary pulse signal sequences by detecting positive and negative null transitions by reference to different voltage thresholds, a first threshold close to the null voltage and a second threshold at a greater potential difference from the null voltage. Preferably hysteresis switches are used, one with a narrow hysteresis range and one with a wider range, both ranges centered on the null value of the audio signal. Furthermore, the switches are caused to return to their rest state after a short while so that the beginning of a pause can be more distinctly shown in the resulting pulse sequences.

The signal pauses are detected and registered when they exceed predetermined time lapse values. In the pulses obtained with low threshold pauses which exceed a first predetermined length that is preferably about twice as great are detected, while the signal pauses of the pulse signal produced with the higher threshold, which exceed a third predetermined length, preferably the size of the second predetermined length, are also detected. Finally, the number of pauses exceeding the predetermined pause length and the time periods of simultaneous or alternate appearance of such signal pauses in the respective pulse sequences into which the audio signal were converted, are utilized as criteria for classifying the signal into three classes, namely music, speech unidentifiable information.

In the practice of the invention, the advantage is obtained that the dynamics of the signal is taken account of by the analog-to-binary-pulse conversion of the audio signal with respect to two considerably different thresholds and the additional processing with reference to pause length criteria. Thus by getting away from the pure evaluation of statistical frequency of occurrences, a reduction of the detection features has been obtained with actual increase of the reliability of recognition. In consequence, fewer false classifications of the signal occur. A supplementary classification for unidentifiable information, in addition to the music and speech classification, provides unambiguous analysis results and makes it possible to terminate and/or repeat the classification procedure because one of the three classifications can be reached after examination of a sample of the audio signal of reasonable length and, furthermore, a stretch of the unidentifiable sort of signal content will be prevented from confusing a succeeding stretch clearly identifiable as music or speech. The electrical circuit expense for the practice of the invention is relatively small, because the analog portion is simplified and the complication of the binary portion (which might be called the "digital" portion, but is rather called "binary" herein to distinguish it from PCM digital signals) is reduced in extent and expense.

In practice, it is convenient to have every negative binary pulse flank correspond to a positive null transition of the audio signal and every positive pulse flank to correspond either to a negative null transition or the beginning of a signal pause, so that measurement of the positive pulse duration may be used for detection of signal pauses of a predetermined minimum magnitude.

In particular, a speech signal is preferably recognized when the number of signal pauses detected with the shorter pause length criterion in the pulse sequence reduced from the audio signal with the lower threshold is greater than three and less than twelve, and the number of signal pauses exeeding the specified criterion of duration detected in the pulse sequence produced from the audio signal with the higher threshold is greater than four. A music signal is preferably recognized when the number of signal pauses longer than the shorter pause criterion in the pulse sequence produced with the lower threshold is greater than three, and the time lapse during which a signal pause of the specified duration is detected in the pulse sequence produced with the higher threshold co-exists with non-detection of signal pauses exceeding the higher pause length criterion detected in the pulse sequence produced by reference to the lower threshold is greater than a fourth predetermined time lapse magnitude. A music signal is preferably also recognized when the number of signal pauses exceeding the lower pause duration criterion in the pulse sequence produced by reference to the lower threshold is less than three, and the period of time of non-detection of signal pauses exceeding the higher duration criterion detected in the same pulse sequence is greater than a fifth predetermined time lapse magnitude which is preferably about twice as great as the fourth predetermined time lapse magnitude.

Furthermore, the audio signal is classified as unidentifiable as either music or speech when the period of time during which signal pauses exceeding the higher duration criterion detected in the pulse sequence produced from the audio signal with reference to the lower threshold is greater than a sixth time lapse magnitude which preferably lies between the fourth and fifth predetermined magnitudes and nearer to the fourth one. Furthermore, an unidentifiable audio signal is also deemed to be found when the number of detections of a signal pause meeting the specified duration criterion in the pulse sequence produced with the higher threshold which is counted during non-detection of signal pauses exceeding the higher duration criterion detected in the pulse sequence produced with reference to the lower threshold is greater than eight.

Finally, an audio signal is deemed to be of an unidentifiable sort when the count of signal pauses exceeding the lower duration criterion detected in the pulse sequence formed with reference to the lower threshold is at least 3 and the time period of non-detection of signal pauses exceeding the higher duration criterion detected in the same pulse sequence is greater than the fifth time lapse magnitude above mentioned.

In practice it is convenient for the lower audio signal conversion threshold to be 0.3 volt, the higher threshold 2.2 volt, the lower pause duration criterion 30 milliseconds, the higher pause duration criterion as well as the specified duration criterion for pauses in the high threshold pause sequence 60 milliseconds, the fourth predetermined time lapse magnitude 1.5 seconds, the fifth 3 seconds and the sixth 1.6 seconds.

In apparatus terms it is desirable to use Schmitt trigger circuits for the analog-to-binary conversion, with switching hysteresis symmetrical about the null point and to use monoflop circuits for application of the time lapse magnitude criteria (pulse duration criteria). Further apparatus details, particularly regarding the classification logic following pause length identification, is described below following mention of the drawings.

BRIEF DESCRIPTION OF THE DRAWINGS

The invention is further described by way of illustrative example with reference to the annexed drawings, in which.

DESCRIPTION OF THE PREFERRED EMBODIMENTS

Figure 1:
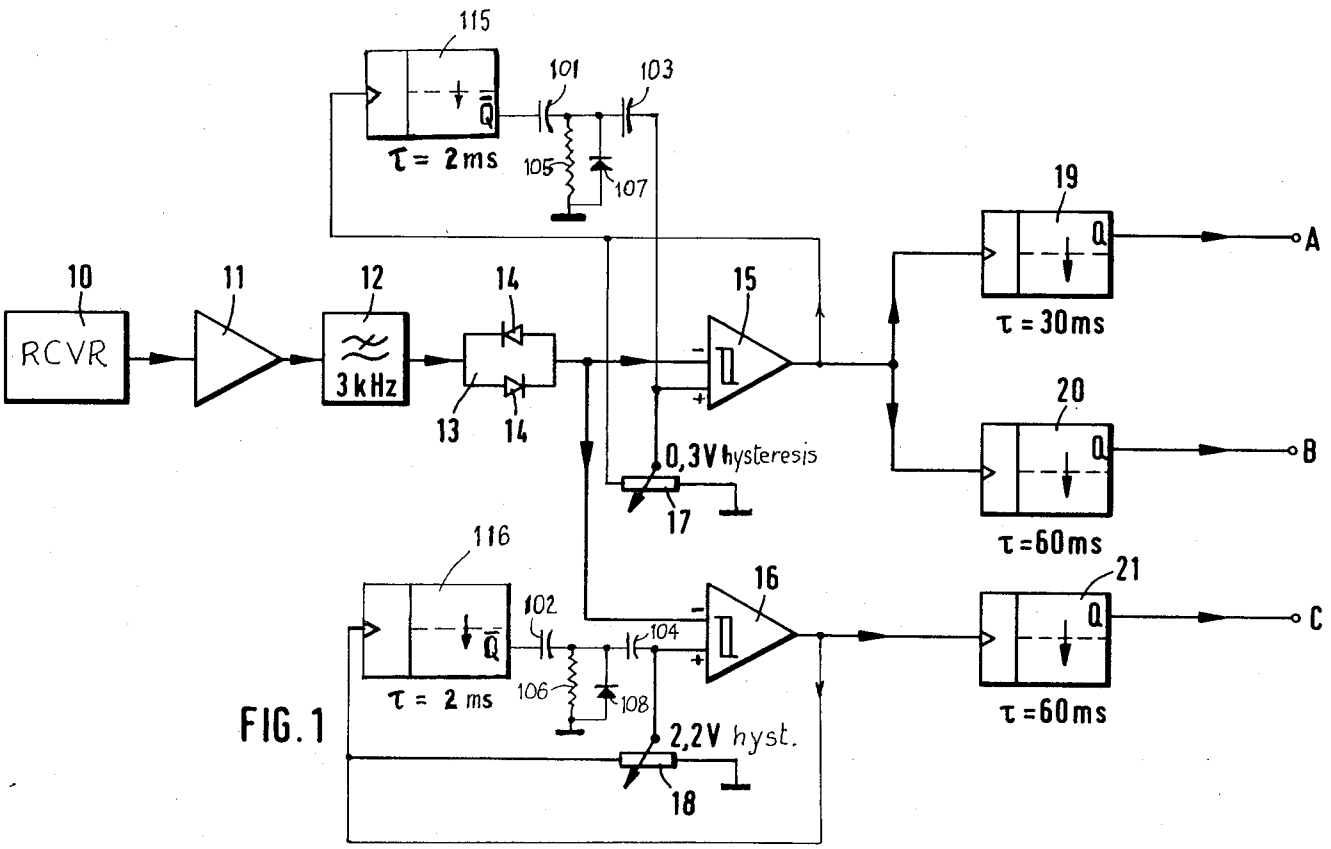
FIG. 1 and FIG. 2 together constitute a block circuit diagram of an audio signal classifying system according to the present invention, FIG. 1 showing the conversion of the audio signal into binary pulse sequences and the provision of pause detection pulses at terminals A, B and C and FIG. 2 showing the processing of the pulse signals at those terminals to provide classification signals at the terminals 23, 24 and 25.
Figure 2:
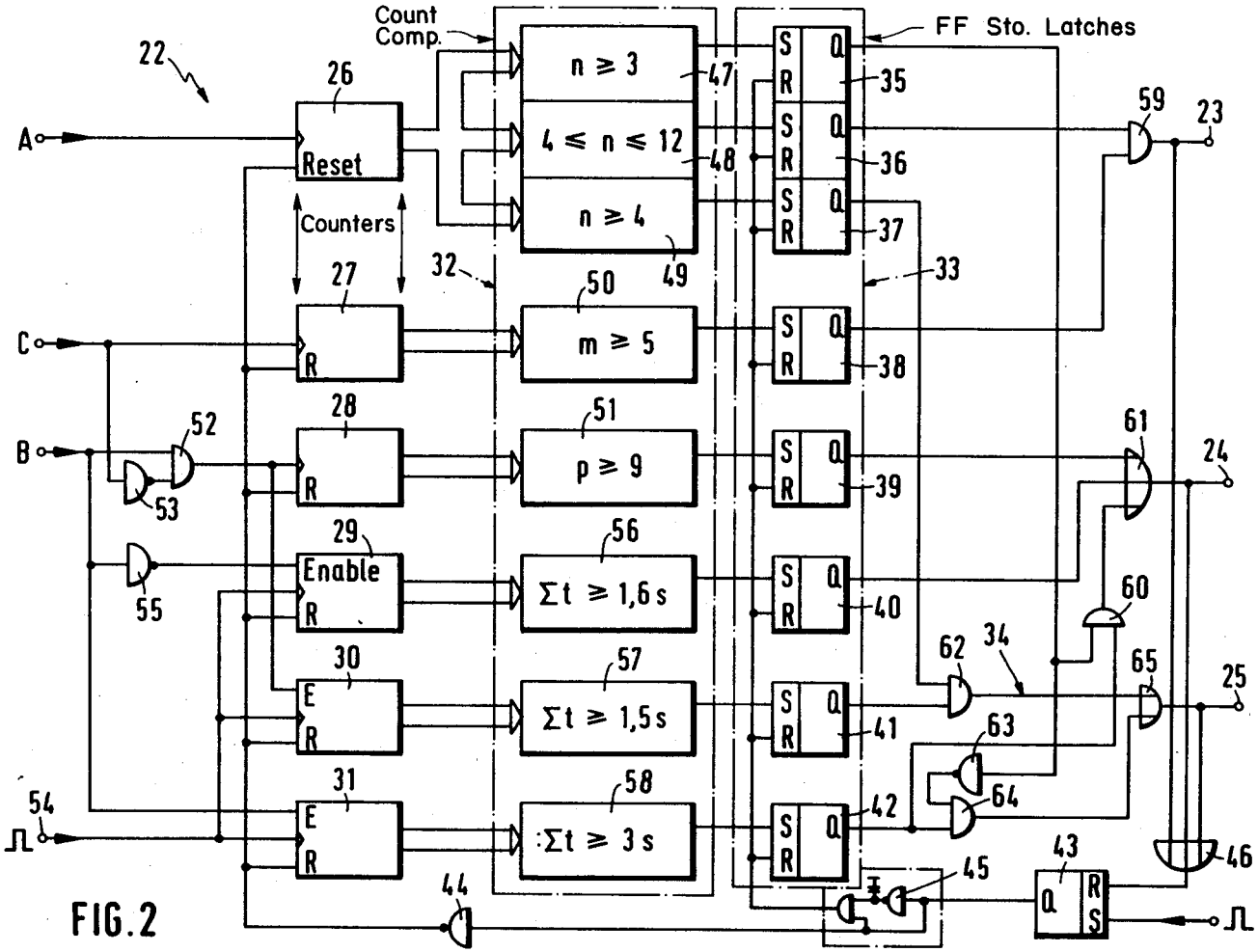

For reasons of clarity the block circuit diagram of the illustrated embodiment of the invention has been divided into two diagrams respectively shown in FIGS. 1 and 2, with the terminals A, B and C representing the connections from one part of the overall diagram to the other. In the circuit portions shown in FIG. 1 the audio signal received in a receiver 10 is prepared for analysis. The output of the receiver 10 is supplied to an amplifier 11 and a low-pass filter 12 having an upper cut-off frequency of about 3 kHz. The output of the filter is compressed in dynamic range by a compander 13 in mutually anti-parallel connection, the signal compression bringing the audio signal into the neighborhood of the null line in order to suppress disturbances. Two comparators 15 and 16 each have an input connected to the output of the companders 1 and are both constituted as Schmitt trigger circuits having a hysteresis characteristic which is symmetrical about the null value. The hysteresis range magnitudes of the comparators 15 and 16 are so determined, by means of adjustable resistors 17 and 18, that the hysteresis range for the comparator 15 is 0.3 volt and that of the comparator 16 is 2.2 volts, thus providing absolute voltage value voltage thresholds of 0.15 volt and 1.1 volts respectively. The two comparators 15 and 16 convert the null transitions of the audio signal in each case into a binary pulse sequence, where each negative pulse flank is produced by a positive null transition of the audio signal and each positive pulse flank is produced either by a negative null transition or by the beginning of a pause in the audio signal. In order to obtain the last-mentioned effect, the comparators 15 and 16 are respectively connected to the monoflops 115 and 116 for resetting initial conditions as will now be described.

Figure 3:
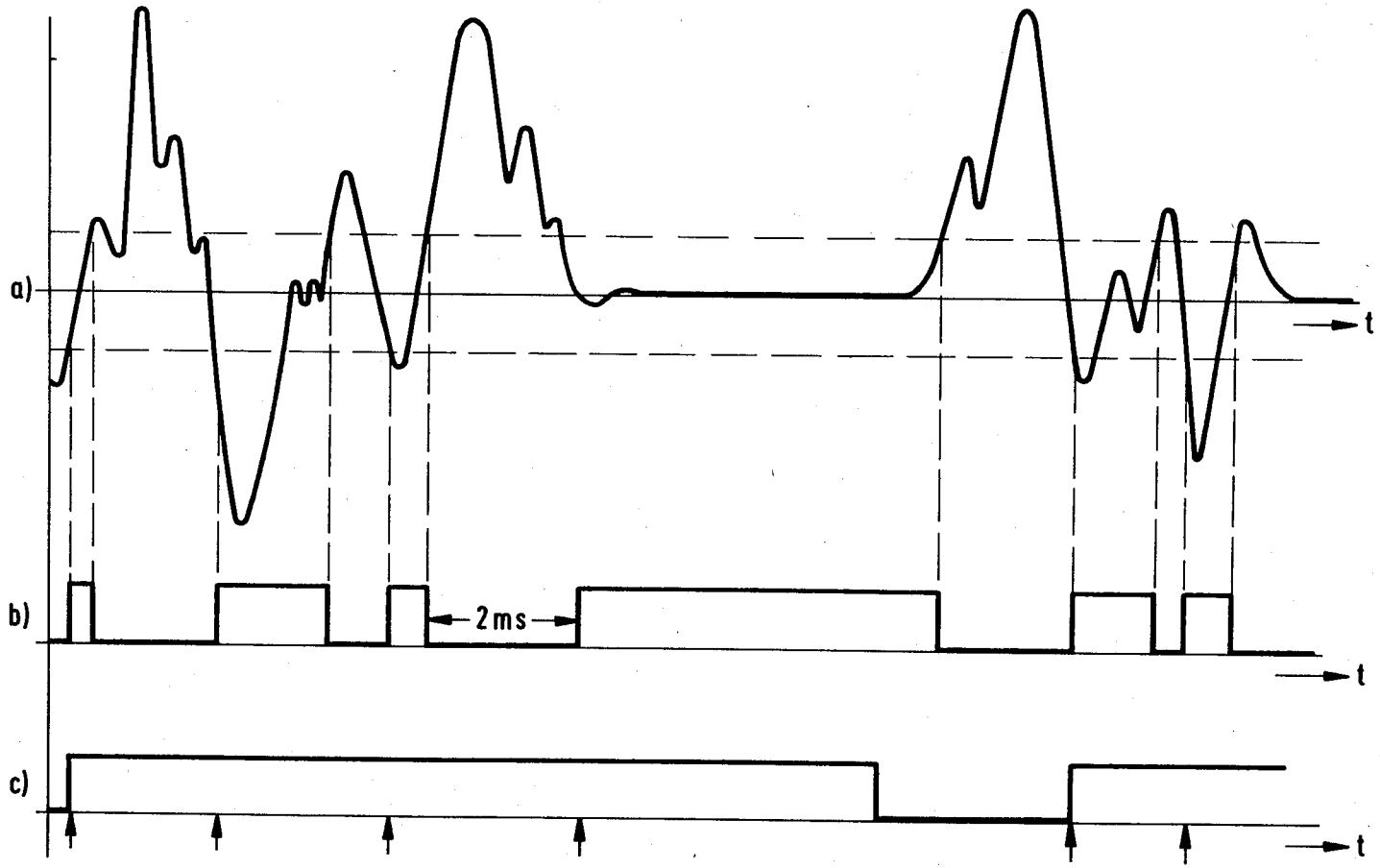
FIG. 3 is a timing diagram illustrating the operation of the circuits shown in FIG. 1.

As already mentioned, the comparator 15 is caused to change its state when a positive null transition of the input signal carries the signal to the threshold of the Schmitt trigger circuit constituted by the comparator 15 and the potentiometer 17 connected as shown in FIG. 1. Since the potentiometer 17 is adjusted for a hysteresis range of 0.3 volts and that range is symmetrically disposed with respect to null potential (ground), the positive boundary of the hysteresis range is 0.15 volt. Since the positive transition is to produce the negative-going flank of the output pulses, the input signal is provided to the inverting input of the comparator 15, as shown. And when the signal passes the positive threshold, the output of the comparator goes negative. That negative-going transition of the output triggers the monoflop 115 which has a period of 2 milliseconds. If there is no negative null transition going as far as the negative limit of the hysteresis range within 2 milliseconds, the monoflop 115 times out and returns to its original state. At that moment, a pulse at its inverting output $\overline{Q}$ is applied through the capacitance-resistance coupling network 101,103,105 to the non-inverting input of the comparator 15 and if by that time the input signal from the compander 13 is within the hysteresis range, the comparator 15 is switched back into its positive output condition (as shown in FIG. 3, line b) at the end of the period marked "2ms" in FIG. 3. The diode 107 short-circuits the turn-on output pulse of the monoflop 115.

The comparator 16 is similarly provided with a monoflop 116 for restoring it to the positive output condition 2 milliseconds after a positive transition reaching its positive hysteresis limit, if at that time the input signal is within the hysteresis range set by the potentiometer 18.

The comparators 15 and 16 both flip back, 2 milliseconds after detecting a positive transition, into the condition in which they provide the output corresponding to the no-signal situation (starting condition), in this case logic signal 1 (compare lines (a) and (b) of FIG. 3).

The 2 millisecond value corresponds to a half period of a 250 Hz wave, which is near the low edge of the usual audio passband for radio broadcast of music. This time interval could be several times greater or, if a bandpass filter with a lower cut-off at, say 500 Hz, were used instead of the low-pass filter 12, it could be reduced to 1.

A first monoflop 19 of the retriggerable type having a time constant of 30 milliseconds and a second retriggerable monoflop 20 with a time constant of 60 milliseconds are connected to the output of the comparator 15, while the output of the comparator 16 is connected to the input of a third retriggerable monoflop 21 having a time constant of 60 milliseconds.

Line (a) of FIG. 3 shows an example of the time course of an audio signal at one input of the Schmitt trigger comparators 15 and 16. The hysteresis range of these comparators is shown by horizontal broken lines and vertical broken lines indicate the switching moments. A pulse sequence such as is schematically shown in line (b) in FIG. 3 then results at the output of the comparators 15 and 16 (since the only difference between the comparators is the hysteresis range, FIG. 3 serves to illustrate the operation of both comparators with merely a change in the vertical scale of the audio signal).

As shown in line (b) at every positive pulse flank one of the monoflops 19–21 is triggered. The output signal that appears at the Q output of one of these monoflops is represented in FIG. 3*c*. Signal pauses having a pause duration greater than 30 ms are detected by the monoflop 19 at the conversion of the audio signal by the comparator 15 and signal pauses greater than 60 ms are detected by the monoflops 20 and 21 respectively for the outputs of the comparators 15 and 16. The detection is produced when the monoflop returns into its logic 0 condition as the result of the fact that within the previous timing period (30 ms or 60 ms) no positive pulse flank has produced a trigger pulse for the monoflop. The negative pulse flank of the output signal at the Q output of the monoflop, as shown in line (c) of FIG. 3 accordingly represents the finding of a signal pause having a pause length greater than the timing period (30 ms or 60 ms) of the monoflop. In line (c) of FIG. 3, the fourth triggering of the monoflop is shown as taking place when the comparator to which it is connected returns to its quiescent state 2 milliseconds after the last previous positive null transition of the audio signal, indicating the beginning of a pause.

As shown in FIG. 2 the Q outputs of the monoflops 19, 20 and 21 are connected to an evaluation circuit collectively designated 22 that has three outputs 23, 24 and 25 at which three different classification signals may respectively appear, namely speech recognition, music recognition and unidentifiable signal designation. The evaluation unit 22 contains three pause counters 26–28 and three time measuring counters 29, 30 and 31. The pause counters 26 and 28 are constituted as pulse counters with count and reset inputs and the time counters 29, 30 and 31 are constituted as pulse counters with count, reset and enable inputs. The pause and time counters 26–31 are interconnected by a threshold value logic unit 32, a storage unit 33 and a correlation logic 34, through which outputs are provided to the three output terminals 23, 24 and 25 of the evaluation circuit 22.

The storage unit 33 consists of a multiplicity of RS latch circuits 35, 36 . . . 42. A start-stop device 43, constituted as an RS flipflop, is connected on one hand with the reset inputs of the pause and time counters 26–31 and on the other hand through a differentiating circuit 45 to the R inputs of the RS latches 35, 36 . . . 42. The start-stop flip-flop 43 is arranged to receive a start pulse at its S input and a stop pulse at its R input. Its S input is, accordingly, connected with a start pulse source not shown in the drawing, while the R input is connected with the output of an OR-gate 46 the three inputs of which are each connected with a different one of the outputs 23–25 of the evaluation circuit 22.

The first pause counter 26 has its count inputs connected with the Q output of the first monoflop 19 while the pause counter 27 has its count input connected with the Q output of the third monoflop 21. Three count state evaluators 47, 48 and 49, have their count state inputs connected in parallel into the count state outputs of the counter 26 and have their respective outputs each connected to the S input of a different one of the RS latches 35, 36 and 37.

The second pause counter 27 has a count stage output connected to the input of a count stage evaluator 50, the output of which is connected with the S input of the fourth RS latch 38. The count input of the third pause counter 28 is connected with the output of an AND-gate 52, of which one input is directly connected to the Q output of the second monoflop 20 and its other input connected through an inverter 53 with the Q output of the third monoflop 21.

The third pause counter 28 has its count state outputs connected to the count state input of a count stage evaluator 51, of which the output is connected to the S input of the fifth RS latch 39.

The first count state evaluator 47 provides an output signal when the count state is equal to or greater than 3, the second count stage evaluator 48 does the same for a count state equal to or greater than 4 but less than or equal to 12, the third count state evaluator 49 operates likewise at a count state equal to or greater than 4, the fourth count evaluator 50 at a count state greater than or equal to 5 and the fifth count state 51 at a count state equal to or greater than 9, all of these evaluator outputs being stored in the RS latches 35, 36 . . . 39 and made available at the Q outputs of the respective latches.

The count inputs of the time counters 29, 30 and 31 are connected with a source 54 of clock pulses symbolically represented by a terminal and a pulse wave form in FIG. 2. These count pulses are, of course, of constant frequency. The enable input of the first time counter 29 is connected through an inverter 55 and to the terminal B, which is connected to the Q output of the second monoflop 20, to which the enable input of the third time counter 31 is directly connected, while the enable input of the second time counter 30 is connected to the count input of the third pause counter 28 and from there through the logic members 52 and 53 (AND-gate and inverter respectively) to the respective Q outputs of the monoflops 20 and 21. The time counters 29, 30 and 31 are respectively connected to threshold value integrators 56, 57 and 58, the outputs of which are in turn connected to the respective S inputs of three further RS latches 40, 41 and 42 of the storage unit 33.

The threshold value integrators 56, 57 and 58 in each case provide an output signal that is stored in the respective one of the RS latches 40, 41 and 42. Whenever the pulse count in the corresponding one of the time counters 29, 30 and 31 oversteps a prescribed threshold value. Since the time counters are advanced with constant count pulse sequence, the threshold value corresponds to a maximum possible sum time and is greater than or equal to 1.6 seconds in the first threshold value integrator 56, equal to or greater than 1.5 seconds in the second threshold value integrator 57 and three seconds in the third threshold value integrator 58.

The Q outputs of the RS latches 35, 36 . . . 45 are correlated by the correlation of logic 34 to the three outputs 23, 24 and 25 of the evaulation unit 22. In this correlation the Q outputs of the first RS latch 35 and of the fourth RS latch 38 are connected through an AND-gate 59 with the output 23 for the provision of a speech recognition signal. The Q outputs of the first RS latch 35 and of the eighth RS latch 42 are connected through an AND-gate 60, of which the output goes through an OR-gate 61 to the output 24 to provide an indication of an unidentifiable signal, the same OR-gate 61 having other inputs to which the Q outputs of the fifth and sixth RS latches 39 and 40 are connected. The Q outputs of the third and seventh RS latches 37 and 41 are connected to input of an AND-gate 62 while the Q output of the eighth RS latch 42 is connected to an AND-gate 64, to the other input of which is connected the output of an inverter 63 to which the Q output of the first RS latch 35 is connected for negation. The outputs of the AND-gates 62 and 64 are connected through an OR-gate with the third output 25 for providing a music recognition signal.

With the above-described circuit an audio-frequency signal received from the receiver 10 is subjected, after amplification in the amplifier 11 and limiting to a bandwidth of about 3 kHz to an analog-to-binary conversion at a low threshold of 0.3 volt (comparator 15) and likewise a similar conversion with reference to a higher threshold of 2.2 volts (comparator 16). Signal pauses of the audio signal are detected by means of the pulse sequences presented at the respective outputs of the comparators 15 and 16, the detected pauses being those which overstep a prescribed duration, 60 ms for both pulse sequences and 30 ms also for the pulse sequence utilizing the lower threshold. Every negative pulse flank at the Q output of the respective monoflops 19, 20 and 21 represents a recognition signal or a pause exceeding the corresponding duration in the audio signal.

The number of the detected signal pauses and the time span of simultaneous or alternate appearance of pauses detected in the one and the other of the pulse sequences are the criteria utilized in the evaulation circuit 22 for identifying the three signal types, namely music, speech and unidentifiable information.

By the circuit connections above described in the evaluation unit 22, the following recognition modalities are carried out:

A speech recognition signal at the output 23 of the evaluation circuit is produced when the number of signal pauses exceeding 30 milliseconds in length (monoflop 19) detected from the pulse sequence into which the audio signal was converted by reference to the 0.3 volt threshold is greater than 3 and smaller than 12 (count state evaluator 48 and RS latch 36), and the number of signal pauses detected in the pulse sequence produced by the higher 2.2 volt threshold (monoflop 21) is greater than 4 (count state evaluator 50, RS latch 38). The coincidence of the two conditions is indicated by the output of the AND-gate 59.

A music recognition signal at the output 25 of the evaluation unit 22 is produced when the number of signal pauses exceeding 30 ms in length (monoflop 19) detected in the pulse sequence obtained by means of the lower 00.3 volt threshold is greater than 3 (count state evaluator 49, RS latch 37) and the time span of the detection of a signal pause by means of the pulse sequence formed with the higher 2.2 volt threshold (monoflop 21) and the contemporaneous non-detection of signal pauses exceeding 60 ms by the pulse sequence produced with reference to the lower 0.3 volt threshold (monoflop 20) is greater than 1.5 seconds (threshold value integrator 57, RS latch 41). The coincidence of the two conditions is found by operation of the AND-gate 62.

A music recognition signal at the output 25 of the evaluation unit 22 is also produced if the number of signal pauses exceeding 30 ms in length (monoflop 19) detected by the pulse sequence produced by reference to the 0.3 volt threshold is smaller than 3 (count state evaluator 47, RS latch 35, invertor 63) and the time span of non-detection of signal pauses of a length exceeding 60 ms by the pulse sequence obtained by reference to the lower threshold of 0.3 volts is greater than about 3 seconds (threshold value integrator 58, RS latch 42). The coincidence of the two conditions is found by the operation of the AND-gate 64.

A signal is classified as relating to unidentifiable information if produced at the output 24 of the evaluation unit 22 in three cases:

1. When the time span in which pauses exceeding 60 ms duration are detected by the pulse sequence produced by reference to the lower 0.3 volt threshold (monoflop 20) is greater than 1.6 seconds (threshold value integrator 56, RS latch 40);
2. The number of detections of a signal pause by means of the pulse sequence formed using the higher threshold of 2.2 volts (monoflop 21) with simultaneous non-detection of signal pauses with duration exceeding 60 ms using the same pulse sequence (monoflop 20) is greater than 8 (count state evaluator 51), and
3. When the count of signal pauses exceeding 30 ms is detected by the pulse sequence produced using the low 0.3 volt threshold (monoflop 19) is greater than or equal to 3 (count state evaluator 47, RS latch 35) and the time span of non-detection of signal pauses of duration exceeding 60 ms by means of the same pulse sequence (monoflop 20) is greater than about 3 seconds (threshold value integrator 58, RS latch 42). The co-existence of the two conditions is found by means of the AND-gate 60.

As soon as one of the classification signals is produced, whether the speech signal at the output 23, the music signal at the output 25 or the indication of an unidentifiable signal at the output 24, a stop pulse is provided to the start-stop circuit 43. In consequence, all pause counters and time counters 26–31 are reset and maintained in that condition. If a new evaluation procedure is to be initiated, a start pulse must be provided to the S input of the start-stop device 43. As a result of such a start signal, all pause and time counters 26–31 are released and all RS latches 35–42 are put into their initial states with the positive flank of the start pulse, this release being performed through the differentiating circuit 45, as the result of which the stored information is erased.

Although the invention has been described with reference to a particular illustrative example, it will be understood that variations and modifications are possible within the inventive concept.

I claim:

1. Method of automatic classification of audio signals based on conversion of the null transitions of an analog audio frequency signal into at least one pulse sequence by reference to voltage thresholds determined by an absolute value of voltage difference from the null value of the analog signal, comprising the steps of:

converting said analog audio frequency signal into a first binary pulse sequence by use of first voltage thresholds determined by a first absolute value of voltage;

converting said analog audio frequency signal into a second binary pulse sequence by use of second voltage thresholds determined by a second absolute value of voltage substantially higher than said first absolute value of voltage;

detecting the pauses of said first binary pulse sequence which exceed a predetermined first time lapse magnitude and thereby producing a first derived pulse sequence;

detecting the pauses of said first binary pulse sequence which exceed a predetermined second time lapse magnitude which is substantially greater than said first time lapse magnitude and thereby producing a second derived pulse sequence;

detecting the pauses of said second binary pulse sequence which exceed a predetermined third time lapse magnitude which is at least about the same magnitude as said second time lapse magnitude and thereby producing a third derived pulse sequence;

determined whether said audio-frequency signal is a speech signal, a music signal or an unidentifiable kind of signal from said derived pulse sequences, by pause count and by simultaneity and/or alternation of pauses detected by said pulse sequences respectively derived from said first and second binary pulse sequences, and preparing readiness for repetition of said method when said determining step is completed.

2. Method according to claim 1 in which both said signal conversion steps are combined with provision of return of the binary pulse sequence to the quiescent signal state after a short time interval of at least one millisecond following the last previous change of binary value away from the signal state corresponding to the quiescent state.

3. Method according to claim 2 in which said binary pulse sequences are so produced that every negative pulse flank of said first and second binary pulse sequence represents a positive null transition of said audio-frequency signal and every positive pulse flank represents either a negative null transition of said audio-frequency signal or the beginning of a pause, and in which the duration of positive pulses of said first and second binary pulse sequences is used to produce, by comparison with reference values of time lapse magnitude, the derived pulses of said derived pulse sequences.

4. Method according to claim 2 in which said second time lapse magnitude is about twice said first time lapse magnitude.

5. Method according to claim 4 in which said second and third time lapse magnitudes are substantially equal.

6. Method according to claim 2, in which the classification determining step includes the substep of determining that said audio-frequency signal is a speech signal when the number of pauses represented by pulses of said first derived pulse sequence is greater than three and less than twelve while the number of pauses represented by pulses of said third derived pulse sequence is greater than four.

7. Method according to claim 2, in which the classification determining step includes the substep of determining that said audio-frequency signal is a music signal when the number of pauses represented by pulses of said first derived pulse sequence is greater than three and the time lapse of a pause represented by said third derived pulse sequence, occurring in the absence of simultaneous representation of a pause by said second derived pulse sequence, exceeds a predetermined fourth time lapse magnitude.

8. Method according to claim 2, in which the classification determining step includes the substep of determining that said audio-frequency signal is a music signal when the number of pauses represented by pulses of said first derived pulse sequence is smaller than 3 and the time lapse of non-detection of pauses represented by said second derived pulse sequence is greater than a predetermined fifth time lapse magnitude, which is substantially greater than said fourth time lapse magnitude.

9. Method according to claim 8 in which said fifth time lapse magnitude is about twice said fourth time lapse magnitude.

10. Method according to claim 2 in which the classification determining step includes the substep of determining that said audio-frequency signal is of an unidentifiable kind when the time lapse during which signal pauses represented by said second derived pulse sequence occur is greater than a sixth time lapse magnitude which is greater than said fourth time lapse magnitude and less than said fifth time lapse magnitude.

11. Method according to claim 2 in which the classification determining step includes the substep of determining that said audio frequency signal is of an unidentifiable kind when the number of signal pauses represented by said third derived pulse sequence occurring during simultaneous non-detection of pauses represented by said second derived pulse sequence is greater than 8.

12. Method according to claim 7 in which the classification determining step includes the substep of determining that said audio-frequency signal is of an unidentifiable kind when the number of pauses represented by pulses of said first derived pulse sequence is at least 3 and the time lapse of non-detection of signal pauses represented by said second derived pulse sequence is greater than said fourth predetermined time lapse value.

13. Method according to claim 10 in which said first absolute voltage value threshold is 0.15 volts, said second voltage value threshold is 1.1 volts, said first predetermined time lapse magnitude is 30 milliseconds, said second predetermined time lapse magnitude and said third predetermined time lapse magnitudes are 60 milliseconds, said fourth predetermined time lapse magnitude is 1.5 seconds, said fifth predetermined time lapse magnitude is 3 seconds and said sixth predetermined time lapse magnitude is 1.6 seconds.

14. Apparatus for connection to a source for automatic classification of audio-frequency signals received from a transmission or recording channel for classification of said signals as speech, music or unidentified signals, comprising:

first and second Schmitt trigger circuits having their inputs connected to said source of audio-frequency signals and having their hysteresis thresholds substantially symmetrically disposed about the null potential of said audio frequency signals as supplied by said source, both said Schmitt trigger circuits having two possible states, one of which corresponds to an initial state in absence of said audio-frequency signals and being equipped with means for assuring return of said circuits to said initial state after an interval of at least one millesecond in the other of said states, said first Schmitt trigger circuit having a small hysteresis voltage range and said second Schmitt trigger circuit having a substantially larger hysteresis voltage range than said first Schmitt trigger circuit;

first and second monoflop timing circuits connected to the output of said first Schmitt trigger circuit for respectively detecting pauses in said audio-frequency signal exceeding first and second predetermined time lapse values;

a third monoflop timing circuit connected to the output of said second Schmitt trigger circuit for detecting gaps in higher amplitude portions of said audio signals exceeding a third predetermined time lapse value, and an evaluation circuit connected to the output of said first, second and third monoflops and containing counters for counting said pauses and gaps detected by said respective monoflop timing circuits, and fourth, fifth and sixth timing circuits, said counters and said fourth, fifth and sixth timing circuits being interconnected for providing signal classification output signals, said evaluation circuit including means for resetting at least said counters promptly after signal classification output signal has been produced.

15. Apparatus according to claim 14, in which the hysteresis range of said first Schmitt trigger circuit is 0.3 V, the hysteresis range of said second Schmitt trigger circuit is 2.2 V, said first predetermined time lapse value is 30 ms and said second and third predetermined time lapse values are both 60 ms.

16. Apparatus according to claim 14, in which said fourth, fifth and sixth timing circuits are incorporated in a time lapse threshold logic circuit having its input connected to the outputs of said monoflop timing circuits, and in which a storage unit and a correlation circuit are located in said evaluation circuit, said storage unit having its inputs connected to the outputs of said time lapse threshold logic circuit and its outputs connected to said correlation circuit, said correlation circuit having outputs providing the respective classification signals.

17. Apparatus according to claim 16, in which said storage unit is composed of an array of RS latch circuits which have their respective Q outputs connected to said correlation circuits.

18. Apparatus according to claim 17, in which said resetting means includes a stop-start circuit (43) constituted as an RS flipflop circuit having a start input and a stop input and an output connected both to the reset inputs of said counters and to said fourth, fifth and sixth timing circuits and to the reset inputs of said RS latch circuits, an OR-gate having its outputs being connected to said stop input and its input connected to said classification signal outputs.

19. Apparatus according to claim 18, in which said counters are pulse counters having counting and reset inputs and said fourth, fifth and sixth timing circuits are constituted as clock pulse counters connected to a source of clock pulses and having counting, enable, and reset inputs.

20. Apparatus according to claim 19, in which said counters have their counting inputs respectively connected to the outputs of said first, second and third monoflop timing circuits and said time lapse threshold logic circuit includes first, second and third count state comparators (47–49) having their inputs connected to the output of the said counter which responds to the output of said first monoflop and their outputs connected respectively to the S inputs of a corresponding number of said RS latch circuits, said first count state comparator providing an output for a count exceeding 2, said second count state comparator providing an output for a count state not less than 4 nor more than 12, and said third count state comparator provides an output for a count state exceeding 3, the outputs of said count state comparators being respectively connected to corresponding S inputs of latch circuits of said RS latch circuits.

21. Apparatus according to claim 20, in which a fourth count state comparator is connected to the output of the said counter which responds to said third monoflop for producing an output in response to a count state exceeding 4 and supplying said output to the S input of one of said RS latch circuits.

22. Apparatus according to claim 21, in which said correlation circuit includes a first AND-gate having its inputs connected to the respective outputs of the said RS latch circuits to which said second and fourth count state comparators are connected and its output connected to one of said classification signal outputs serving to provide speech classification signals.

23. Apparatus according to claim 21, in which said correlation circuit includes a second AND-gate having one input connected for receiving a negated output of said third monoflop timing circuit and another output connected for receiving a normal output of said second monoflop timing circuit, said AND-gate having its output connected to the counting circuit of said third counter, and in which a fifth count state comparator is connected to said third counter which fifth count state comparator is constituted to provide an output to the S input of one of said RS latch circuits for a count state exceeding 8.

24. Apparatus according to claim 20, in which first, second and third threshold value integrators are connected to the respective counters of said fourth, fifth and sixth timing circuits for respectively producing signals when time lapses of 1.6 S and 1.5 S and 3 S are detected furnishing said signals to S inputs of respective latch circuits of said array of RS latch circuits.

25. Apparatus according to claim 24, in which said time lapse threshold logic circuit includes means for connecting the enable input of said fourth timing circuit with an inverting output of said second monoflop timing circuit, means for connecting the enable input of said sixth timing circuit with a normal output of said second monoflop, and means for connecting the enable input of said fifth timing circuit in parallel with the counting input of said sixth timing circuit.

26. Apparatus according to claim 25, in which said correlation circuit includes a third AND-gate (60) having its inputs connected respectively to the outputs of said RS latch circuit connected to said first count state comparator and to said RS latch circuit connected to the output of said third threshold value indicator and an OR-gate (61) having inputs connected respectively to the output of said third AND-gate and to the outputs of said RS latch circuits connected respectively to said fifth count state comparator and said first threshold value integrator, the output of said OR-gate being connected to one of said classification signal outputs which serves to supply signals indicating said unidentifiable signal classification.

27. Apparatus according to claim 26, in which said correlation circuit includes a fourth AND-gate (62) having its inputs connected respectively to the said RS latch circuits connected to said third count state comparator and to said second threshold value integrator, a fifth AND-gate (64) having its inputs connected for respectively receiving a negated output of said RS latch circuit connected to said first count state comparator and a normal output from said RS latch circuit connected to said third threshold value integrator, and an OR-gate (65) having its inputs connected to the outputs of said fourth and fifth AND-gates, said OR-gate having its output connected to one of said signal classification outputs serving to provide music classification signals.

28. Apparatus according to claim 1, in which a filter having a cut-off frequency above its passband located in the neighborhood of 36 Hz is interposed between said source of audio-frequency signals and the inputs of said first and second Schmitt trigger circuits.

* * * * *